US008368624B2

(12) United States Patent
Liao et al.

(10) Patent No.: US 8,368,624 B2
(45) Date of Patent: Feb. 5, 2013

(54) DISPLAY METHOD WITH INTERLACING REVERSAL SCAN AND DEVICE THEREOF

(75) Inventors: Jhen-Shen Liao, Taoyuan County (TW); Kuan-Hung Liu, Taipei Hsien (TW); Yi-Nan Chu, Changhua Hsien (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 934 days.

(21) Appl. No.: 12/025,780

(22) Filed: Feb. 5, 2008

(65) Prior Publication Data

US 2008/0252625 A1 Oct. 16, 2008

(30) Foreign Application Priority Data

Apr. 14, 2007 (TW) ..... 96113179 A

(51) Int. Cl.
*G09G 3/36* (2006.01)

(52) U.S. Cl. ..... 345/87; 348/793

(58) Field of Classification Search ..... 345/87–104; 348/793

See application file for complete search history.

(56) References Cited

U.S. PATENT DOCUMENTS

| | | | | |
|---|---|---|---|---|
| 5,365,284 | A * | 11/1994 | Matsumoto et al. | 348/793 |
| 7,161,573 | B1 * | 1/2007 | Takatori et al. | 345/96 |
| 2005/0190170 | A1 | 9/2005 | Shin | |

FOREIGN PATENT DOCUMENTS

| | | |
|---|---|---|
| JP | 2001014319 | 1/2001 |
| JP | 2001281623 | 10/2001 |
| JP | 2001290122 | 10/2001 |
| JP | 2001318363 | 11/2001 |
| TW | I273546 | 2/2007 |

OTHER PUBLICATIONS

"1st Office Action of China counterpart application", issued on Jun. 19, 2009, p. 1-p. 6.

* cited by examiner

*Primary Examiner* — Chanh Nguyen
*Assistant Examiner* — James Nokham
(74) *Attorney, Agent, or Firm* — Jianq Chyun IP Office

(57) ABSTRACT

A display method with interlacing reversal scan and a device thereof are provided. The scan mode is interlacing reversal scan. Thus, in time and space, each color frame with poor luminance response can be alternately distributed on up-side and the down-side region of the frame instead on low-side region of the frame. Then, during the period of continuous frame displaying, the present invention may balance color distribution between the up-side and the down-side region, and effectively reduce the flicker phenomenon of the frame.

6 Claims, 12 Drawing Sheets

DISPLAY METHOD WITH INTERLACING REVERSAL SCAN AND DEVICE THEREOF

CROSS-REFERENCE TO RELATED APPLICATION

This application claims the priority benefit of Taiwan application serial no. 96113179, filed on Apr. 14, 2007. The entirety of the above-mentioned patent application is hereby incorporated by reference herein and made a part of this specification.

BACKGROUND OF THE INVENTION

1. Field of the Invention

The present invention relates to a display method and a device thereof. More particularly, the present invention relates to a display method with interlacing reversal scan and a device thereof.

2. Description of Related Art

In recent years, flat panel displays are developed rapidly owing to mature photoelectric technology and semiconductor manufacturing technology. Liquid crystal displays (LCD) advantageous in low-voltage operation, no-radiation, lightness, and small volume have gradually replaced conventional cathode-ray tube (CRT) displays and become a mainstream produce in the market.

An LCD mainly includes a liquid crystal panel and a backlight module. As the liquid crystal which is injected into the liquid crystal panel does not emit light itself, the liquid crystal panel must be illuminated by a surface light source provided by the backlight module, so that the LCD can display.

The color display mixing can be classified into a temporal color mixing and a spatial color mixing methods. For the color display mixing of a display, currently, spatial with additive color mixing is generally applied to a display. Taking thin-film transistor LCD (TFT-LCD) for example, each pixel which is composed of three sub-pixels of red, green, blue (RGB) distributed on a color filter, and when the sub-pixels are small beyond the distinguishable viewing angle of human eyes, a color mixing effect is observed by visual perception.

If the spatial color mixing of the TFT-LCD is replaced by a temporal color mixing, the color filter is not used for achieving the color mixing effect, the backlight source is directly used with relative data display to achieve the temporal color mixing effect, thereby increasing the transmission rate of the module and saving the overall manufacturing cost of the module.

FIG. 1 is an architectural diagram of a driving circuit of a conventional field sequential display (FSD). Referring to FIG. 1, an FSD controller 103 is used to convert spatial parallel RGB video data at a system of a video source 101 into temporal serial R→G→B video data and then output it. As the video data is enormous in quantity, a frame memory 107 and the FSD controller 103 must be used, and a backlight module 105 is controlled in sync during the converting process, such that according to different primary color data to be displayed, a corresponding light source is lightened to make a panel module 109 to display a video image.

FIG. 2 is a conventional FSD driving waveform diagram. Referring to FIG. 2, in order to preventing a false color mixing when the RGB data is written through scanning, the backlight module 105 is turned on or off according to data scanning. When the data is written, the light source of the backlight module 105 is turned off. After the data is written, the light source of the backlight module 105 is turned on, so as to achieve the temporal color mixing of the RGB and to prevent the occurrence of false color mixing.

FIG. 3 is a luminance response diagram of a conventional FSD. Referring to FIG. 3, as the color sequential method has shortened a response time of the liquid crystal, the sequence of the address data is more sensitive than the conventional LCD. Referring to FIG. 3, it can be found that the time from the originally written data (the first several scan lines) to the light source of the backlight module 105, being turned on, is relatively long, i.e., the response time of the liquid crystal is relatively long. Therefore, when the light source of the backlight module 105 is turned on, the luminance response of the liquid crystal can reach a set value. Said time from the last written data (last several scan lines) to the light source of the backlight module 105, being turned on, is relatively short. Thus, the time for the liquid crystal luminance response to reach a set value is not enough and then the color distribution between the up-side and the down-side region of the entire frame may be uneven. In the conventional art, for example, Japanese Laid-Open Patent Application No. 2001-318363, relating to color sequential method, does not provide a solution to this problem.

FIG. 4 is a conventional double frequency FSD response diagram. Referring to FIG. 4, currently, there are two methods for balancing the color distribution between the up-side and the down-side region. When the first method is used, the driving frequency is increased to double the conventional one. Therefore, the response time of each pixel can be made consistent. However, when the driving frequency is doubled, the hardware performance is required to be enhanced, thus increasing the cost of the hardware.

FIGS. 5A and 5B are diagrams of a conventional reversal scan mode. FIGS. 6A and 6B are response diagrams of transmission rate of the conventional reversal scan mode in FIGS. 5A and 5B. Referring to FIGS. 5A, 5B, 6A, and 6B, the scanning sequence is achieved in a reversal manner. Thus, each color frame with poor luminance response can be alternately distributed on the up-side and the down-side region of the frame instead of being concentrated on the low-side region. As such, during the continuous frame displaying period, the present invention may balance color distribution between the up-side and the down-side region. However, another serious problem may exist. If the luminance difference between the up-side and the down-side region is too great, the flicker phenomenon in a large scope is easily generated when there is no balanced effect in space.

It may be clearly observed from the above description that the problem of uneven color distribution between the up-side and the down-side region exists the conventional art. If the problem is solved by increasing the operating frequency, the hardware cost will be increased. Further, if the problem is solved by reversal scan mode, a serious flicker phenomenon is incurred.

In view of the above, panel manufacturers are in urgent need of a proper solution to solve the aforementioned problems.

SUMMARY OF THE INVENTION

The present invention is directed to a display method with interlacing reversal scan, for balancing color distribution between the up-side and the down-side region, and effectively reducing the flicker phenomenon of a frame.

The present invention is also directed to a display method with interlacing reversal scan, which cannot only balance color distribution between the up-side and the down-side region without increasing the operating frequency and the cost, but also alleviate the flicker phenomenon of a frame as well as reduce color breakup.

The present invention is further directed to a display device with interlacing reversal scan for balancing color distribution between the up-side and the down-side region, and effectively reducing the flicker phenomenon of a frame.

As embodied and broadly described herein, a display method with interlacing reversal scan is provided. The method includes in a first frame scanning period, alternately scanning a plurality of odd scan lines and a plurality of even scan lines in an odd/even interlacing sequence, in which a scanning sequence of the odd scan lines is from an up-side of the first frame to a down-side of the first frame, and a scanning sequence of an even scan lines is from the down-side of the first frame to the up-side of the first frame.

In the display method with interlacing reversal scan according to an embodiment of the present invention, the display method further includes in a second frame scanning period, alternately scanning the odd scan lines and the even scan lines in an odd/even interlacing sequence, in which a scanning sequence of the odd scan lines is from a down-side of the second frame to an up-side of the second frame, and a scanning sequence of the even scan lines is from the up-side of the second frame to the down-side of the second frame.

As embodied and broadly described herein, a display method with interlacing reversal scan is provided. The method includes in a first frame scanning period, scanning a plurality of odd scan lines and a plurality of even scan lines in an odd/even sequence, in which a scanning sequence of the odd scan lines is from an up-side of the first frame to a down-side of the first frame, and a scanning sequence of the even scan lines is from the down-side of the first frame to the up-side of the first frame.

In the display method with interlacing reversal scan according to an embodiment of the present invention, the display method further includes in a second frame scanning period, scanning the odd scan lines and the even scan lines in an odd/even sequence, in which a scanning sequence of the odd scan lines is from a down-side of the second frame to an up-side of the second frame, and a scanning sequence of the even scan lines is from an up-side of the second frame to a down-side of the second frame.

As embodied and broadly described herein, a display device of interlacing reversal scan including a timing control unit and a panel module is provided. The timing control unit is used for receiving a video source, and outputting a first control signal and a second control signal according to the video source. The panel module is coupled to the timing control unit, for respectively driving a plurality of odd scan lines and a plurality of even scan lines of the panel module according to the first control signal and the second control signal, so as to display a plurality of frames. In a first frame scanning period, the odd scan lines and the even scan lines are alternately scanned in an odd/even interlacing sequence, the scanning sequence of the odd scan lines is from the up-side of the first frame to the down-side of the first frame, and the scanning sequence of the even scan lines is from the down-side of the first frame to the up-side of the first frame.

In the display device with interlacing reversal scan according to an embodiment of the present invention, in a second frame scanning period, the odd scan lines and the even scan lines are alternately scanned in an odd/even interlacing sequence, in which the scanning sequence of the odd scan lines is from the down-side of the second frame to the up-side of the second frame, and the scanning sequence of the even scan lines is from the up-side of the second frame to the down-side of the second frame.

The scan manner of the present invention is achieved by the interlacing reversal scan. Thus, no matter in time and space, each color frame with poor luminance response can be alternately distributed on the up-side and the down-side region of the frame instead of being concentrated on the down-side region. As such, during the period of continuous frame displaying, the present invention can not only balance color distribution between the up-side and the down-side region without increasing the operating frequency and the cost, but also alleviate the flicker phenomenon of the frame as well as reduce the color breakup.

In order to make the aforementioned and other objectives, features, and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
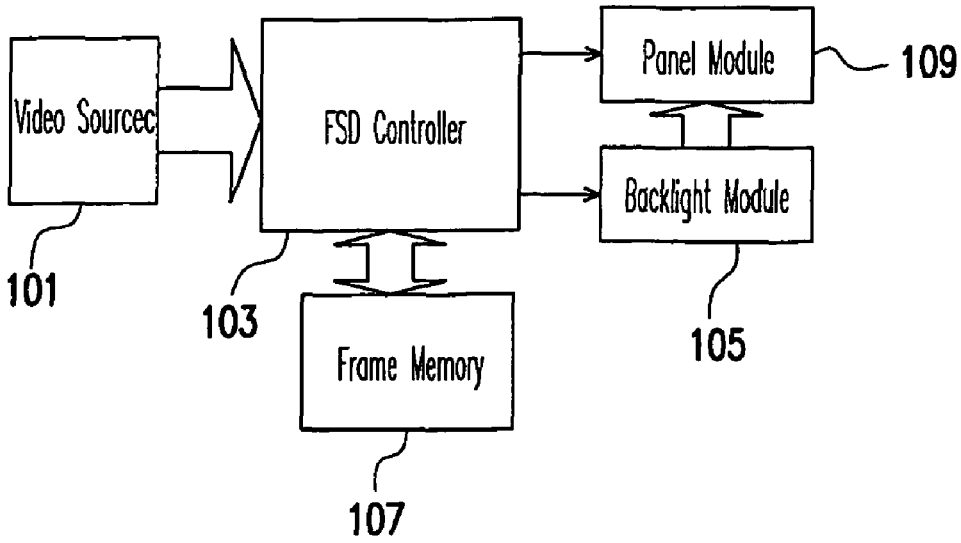
FIG. 1 (PRIOR ART)
FIG. 1 is an architectural diagram of a driving circuit of a conventional FSD.
Figure 2:
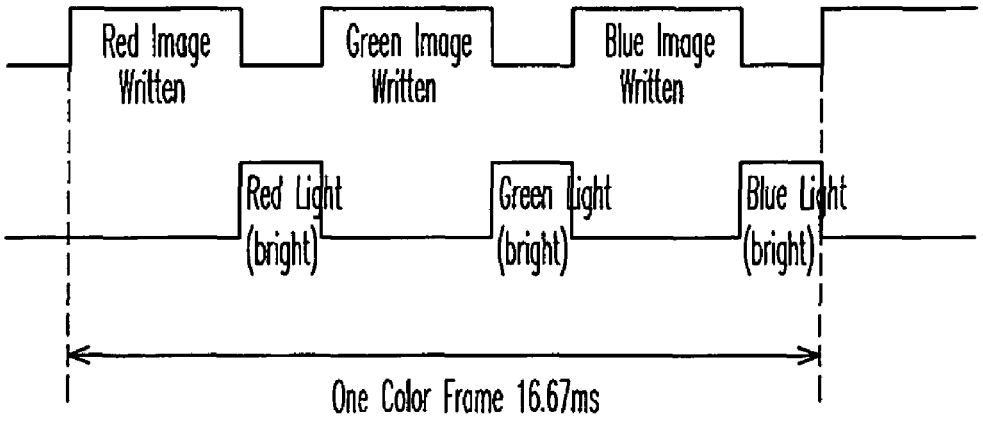
FIG. 2 (PRIOR ART)
FIG. 2 is a conventional FSD driving waveform diagram.
Figure 3:
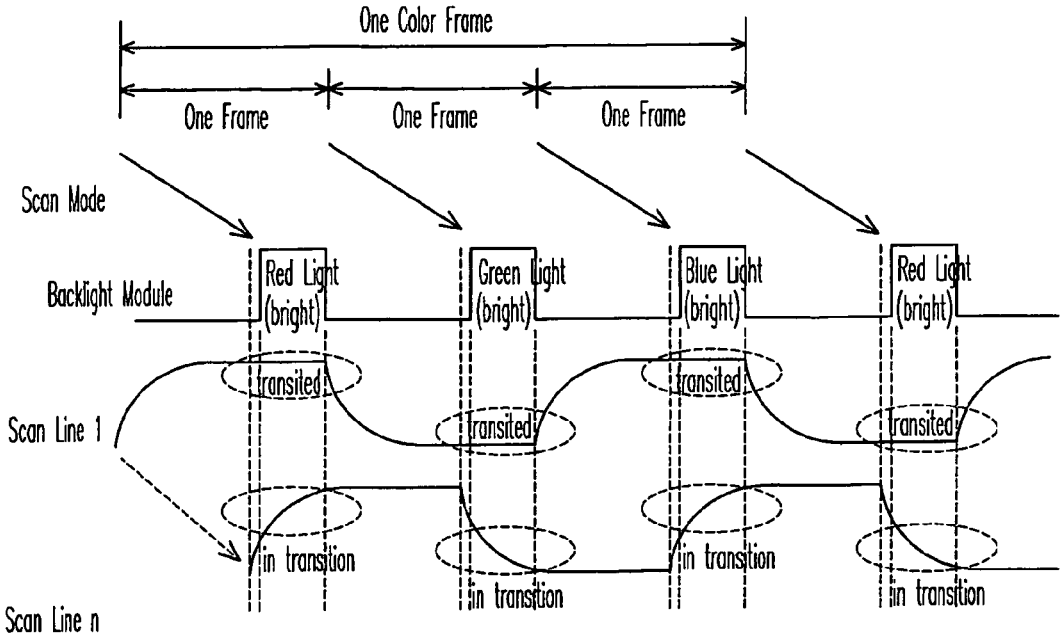
FIG. 3 (PRIOR ART)
FIG. 3 is a conventional FSD luminance response diagram.
Figure 4:
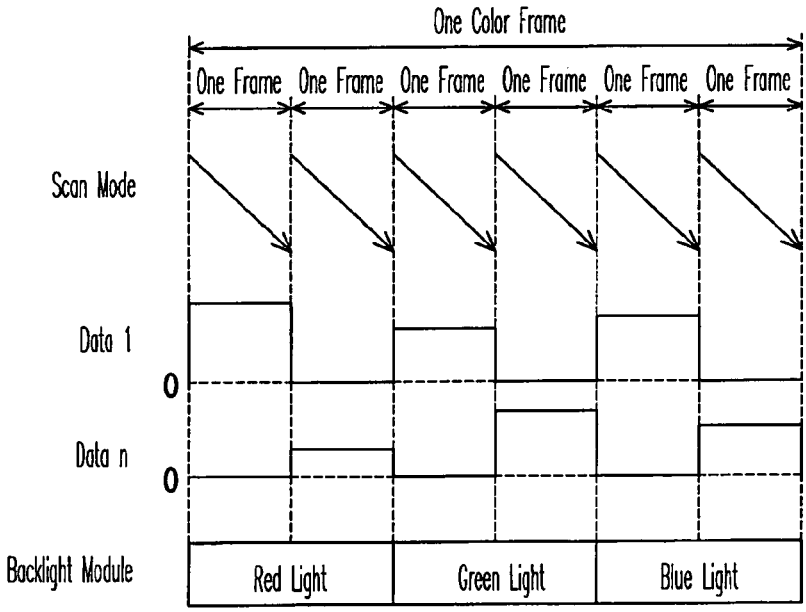
FIG. 4 (PRIOR ART)
FIG. 4 is a conventional double frequency FSD luminance response diagram.
Figure 5A:
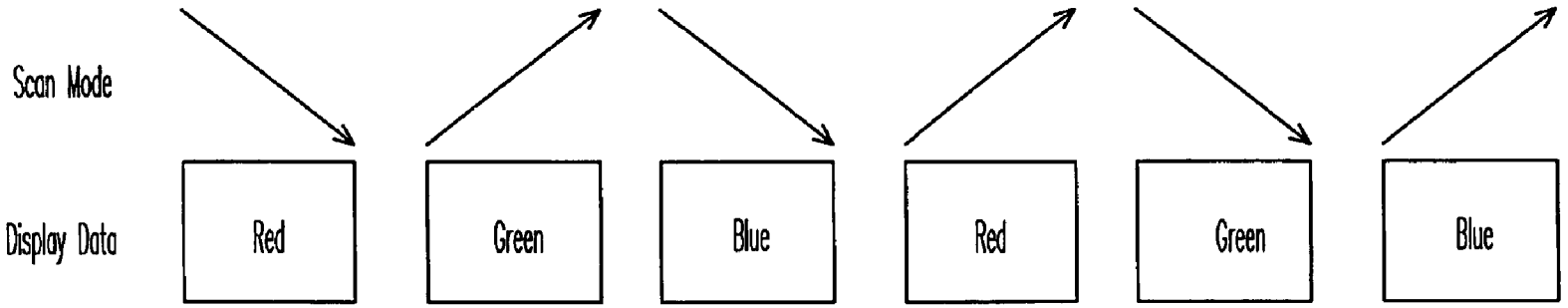
FIG. 5A (PRIOR ART)
FIG. 5A is a diagram of a conventional reversal scan mode.
Figure 5B:
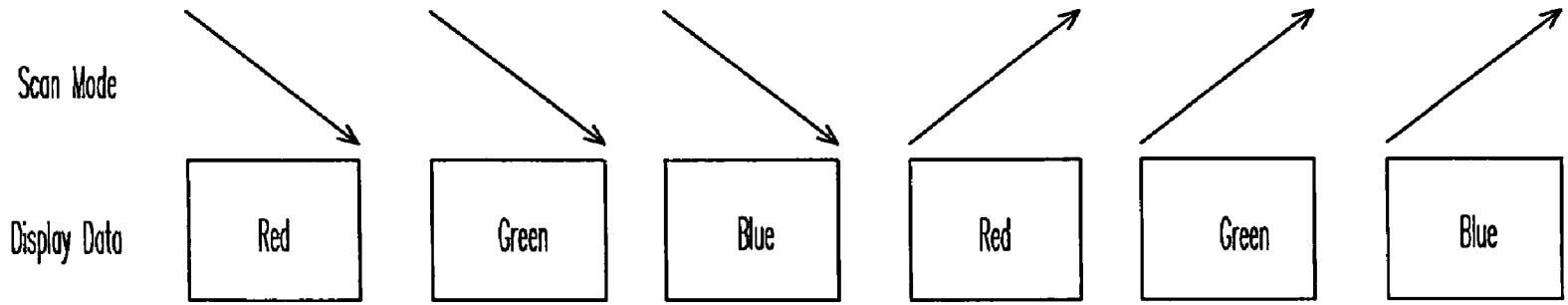
FIG. 5B (PRIOR ART)
FIG. 5B is a diagram of another conventional reversal scan mode.
Figure 6A:
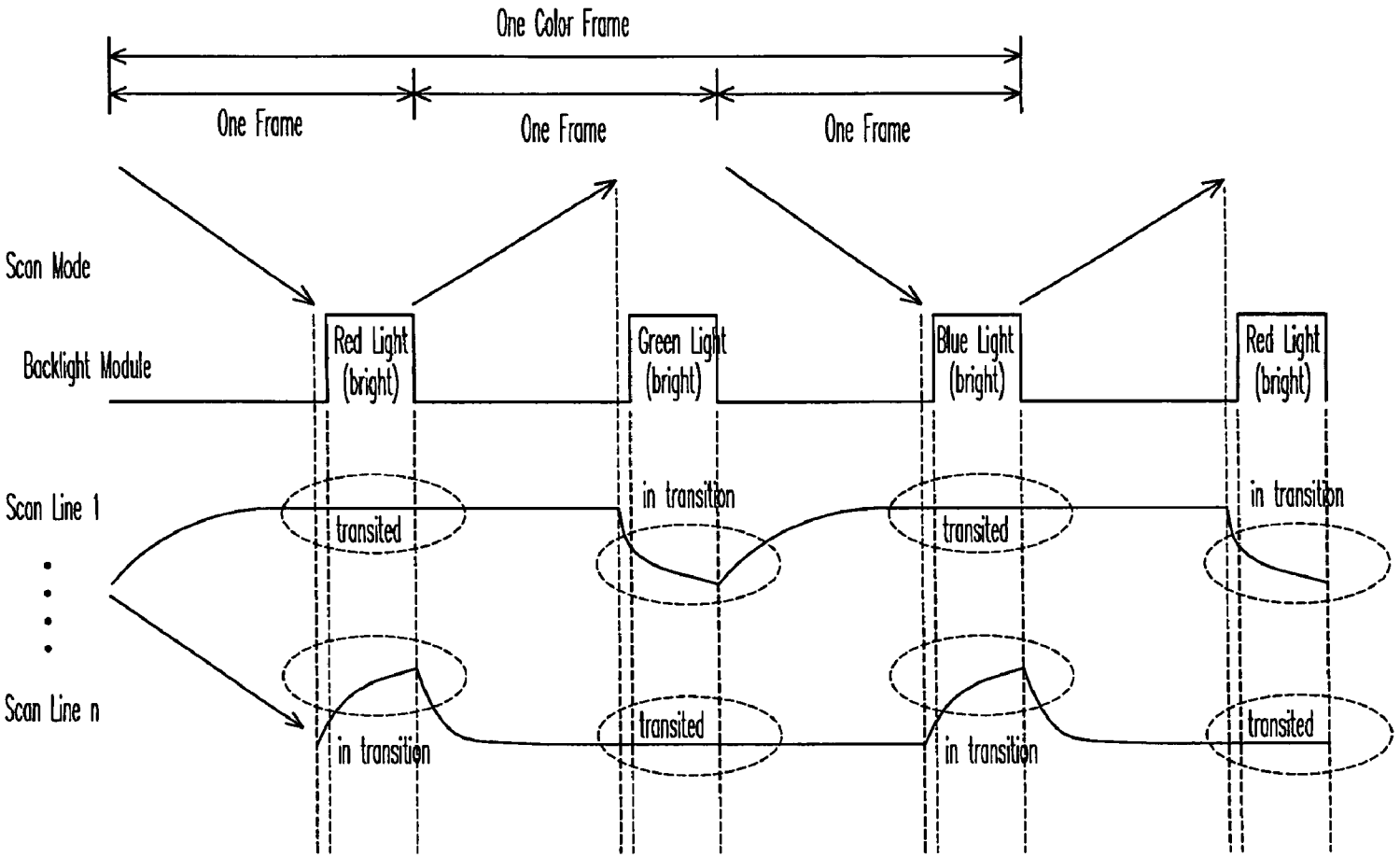
FIG. 6A (PRIOR ART)
FIG. 6A is a response diagram of a transmission rate of the conventional reversal scan mode in FIG. 5A.
Figure 6B:
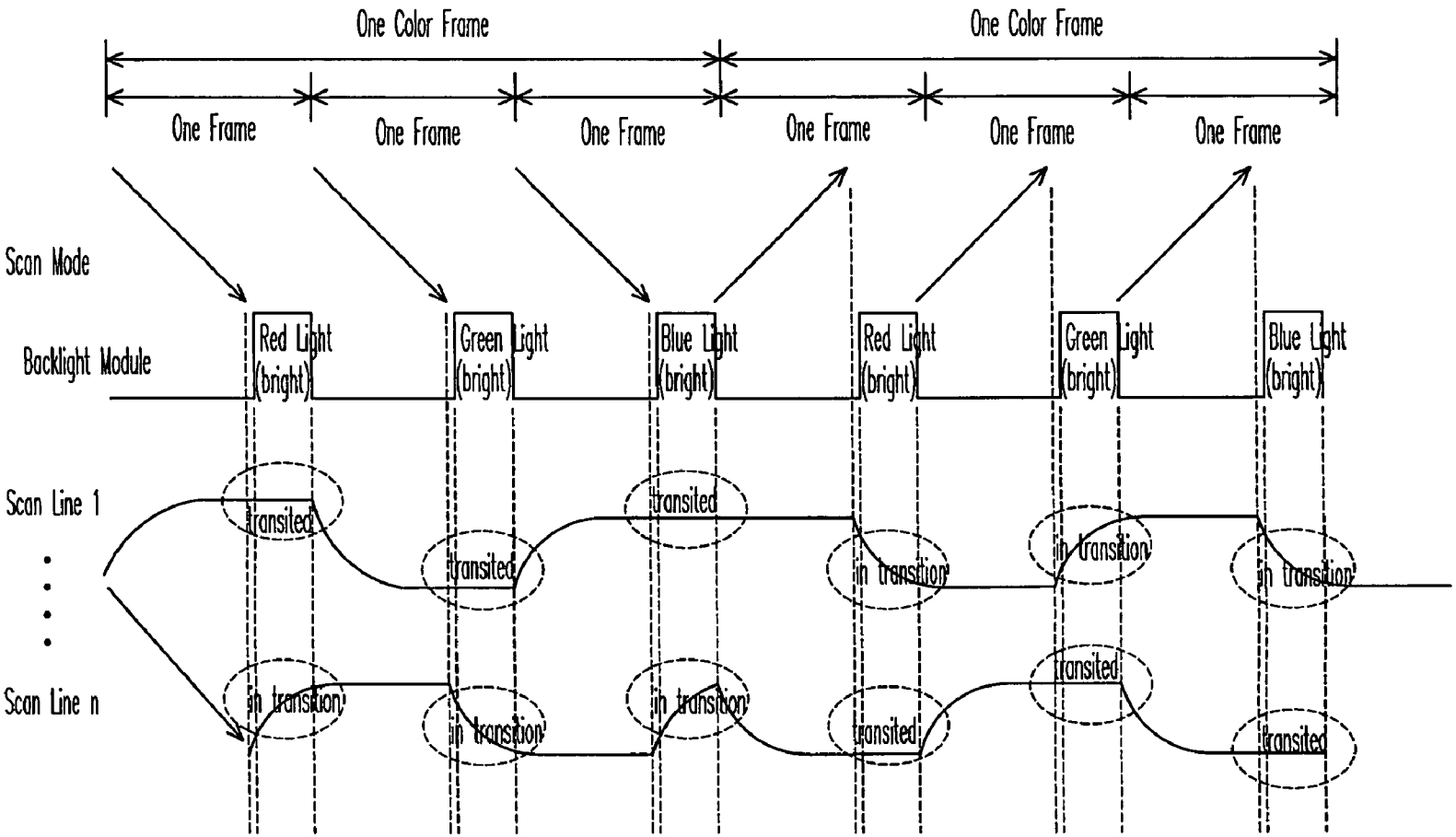
FIG. 6B (PRIOR ART)
FIG. 6B is a response diagram of a transmission rate of the conventional reversal scan mode in FIG. 5B.
Figure 7A:
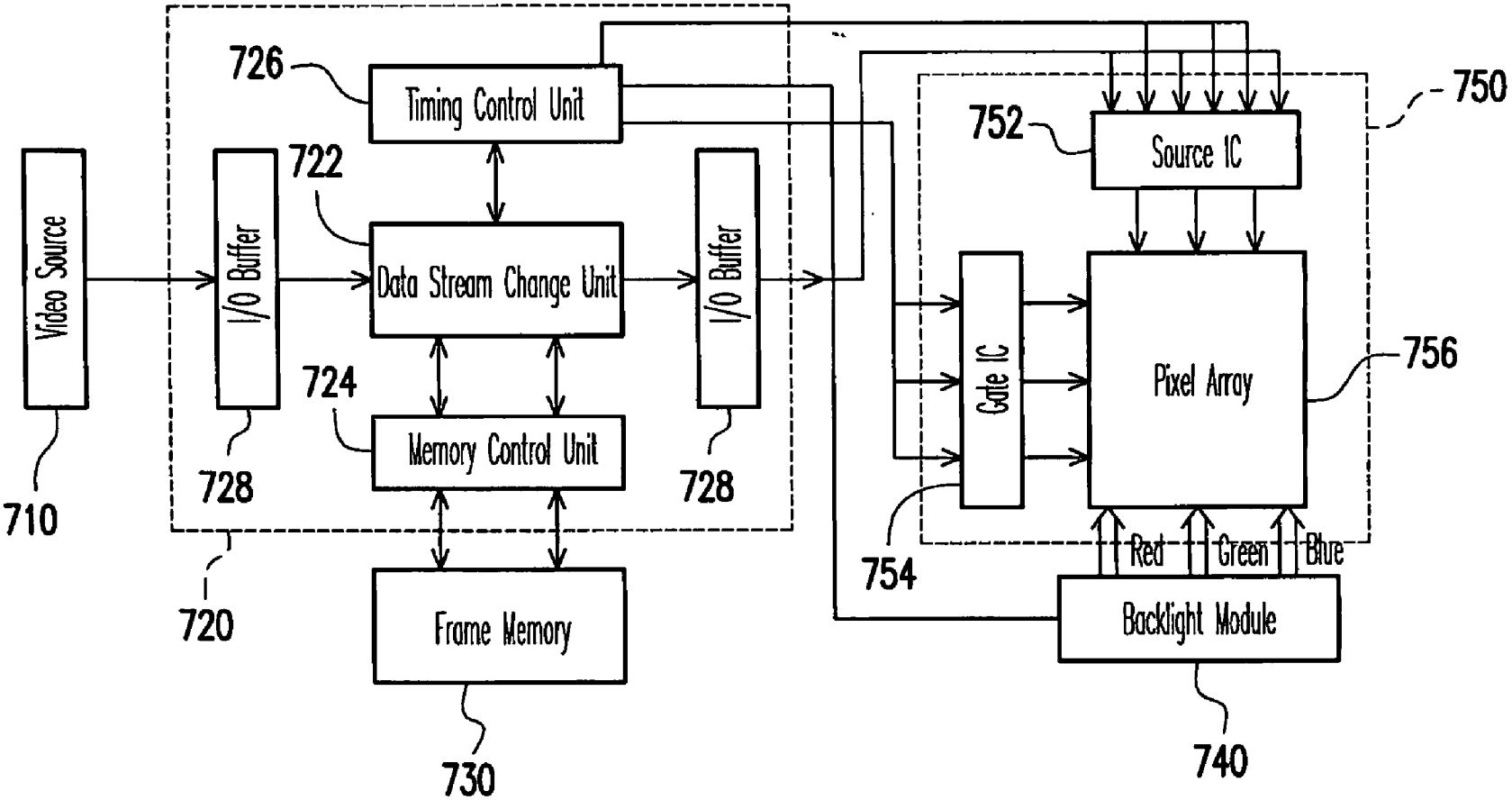
FIG. 7A is a system architectural diagram of a reversal scan display device according to an embodiment of the present invention.

FIG. 7A is a system architectural diagram of a reversal scan display device according to an embodiment of the present invention. Referring to FIG. 7A, the display device includes a video source 710, an FSD controller 720, a frame memory 730, a backlight module 740, and a panel module 750. The video source 710 is used for providing video data. The FSD controller 720 further includes a data stream change unit 722, a memory control unit 724, a timing control unit 726, and an I/O Buffer 728.

A subsidiary data stream change unit 722 of the FSD controller 720 is for converting a spatial parallel RGB signal source of the video source 710 into temporal serial R→G→B signals and then outputting it. The video data is enormous in quantity, so the frame memory 730 must be used to store data which is calculated by the FSD controller 720. A subsidiary memory control unit 724 of the FSD controller 720 is for sending out a memory control signal to control the access of the memory. The timing control unit 726 is for controlling the backlight module 740 to lighten a corresponding light source according to different primary color data which is able to be displayed. The FSD controller 720 is to generate a control signal of a source integrated circuit (source IC) 752 and a control signal of a gate integrated circuit (gate IC) 754 for the panel module 750. The direction control signal of the source IC 752 and the gate IC 754 is realized by means of access with 2-way. The direction setting of the driving circuit is controlled by the FSD controller 720. The source IC 752 and the gate IC 754 receive a control signal which is sent from the timing control unit 726 in cooperation with the data stream change unit 722 so as to determine the scanning sequence of the scan lines in the pixel array 756, thereby achieving an interlacing reversal scan mode. The details will be illustrated as follows.

Figure 7B:
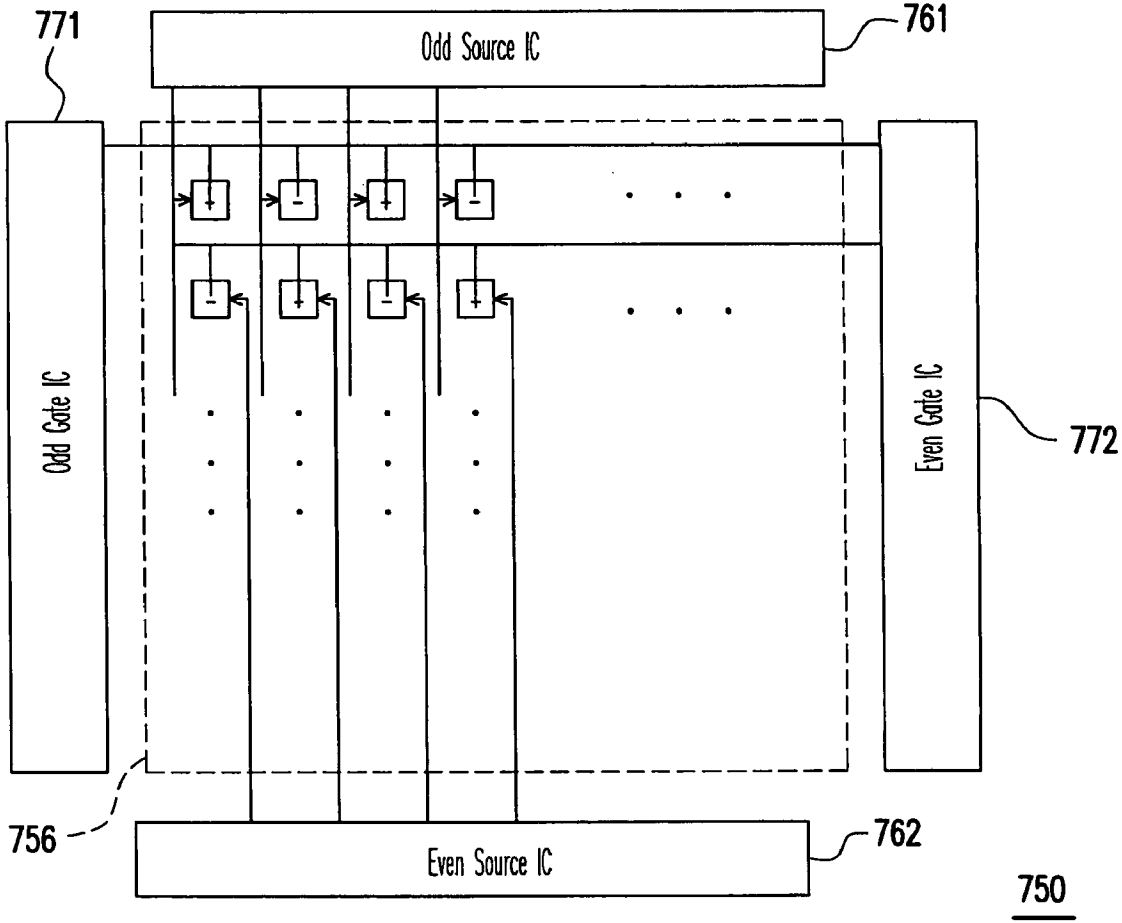
FIG. 7B is an architectural diagram of another panel module according to an embodiment of the present invention.

In another embodiment, those of ordinary skill in the art may change the implementation manner of the panel module 750 as required. For example, FIG. 7B is an architectural diagram of another panel module according to an embodiment of the present invention. Referring to FIGS. 7A and 7B, the source IC 752 in FIG. 7A is divided into an odd source IC 761 and an even source IC 762 individually in FIG. 7B. The gate IC 754 in FIG. 7A is divided into an odd gate IC 771 and an even gate IC 772 individually in FIG. 7B. In other words, in FIG. 7B, the odd source IC 761 and the odd gate IC 771 are used to control the odd scan lines of the pixel array 756, and the even source IC 762 and the even gate IC 772 are used to control the even scan lines of the pixel array 756. As such, it is easier to control the odd scan lines and the even scan lines of the pixel array 756.

Figure 7C:
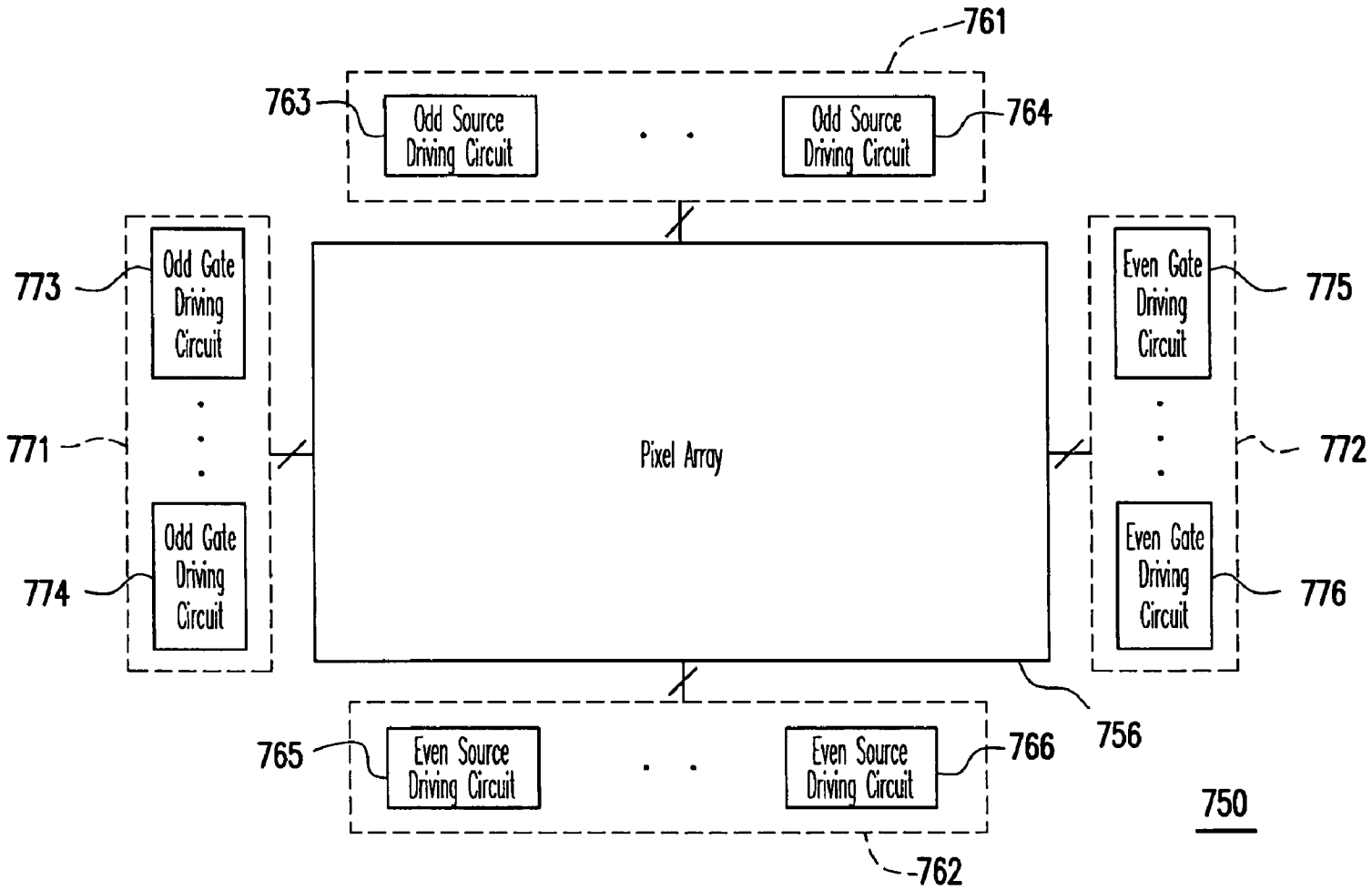
FIG. 7C is an architectural diagram of yet another panel module according to an embodiment of the present invention.

In diagram of the above embodiments, the size of the pixel array 756 is fabricated for being increasingly larger according to consumers' requirements. For the convenience of control, those of ordinary skill in the art control the pixel array 756 by divisions as required. For example, FIG. 7C is an architectural diagram of yet another panel module according to an embodiment of the present invention. Referring to FIG. 7C, the odd source IC 761 includes odd source driving circuits 763-764, and the even source IC 762 includes even source driving circuits 765-766, for controlling the pixel array 756 in different blocks. The odd gate IC 771 includes odd gate driving circuits 773-774, and the even gate IC 772 includes even gate driving circuits 775-776, for controlling the pixel array 756 in different blocks. As such, the load of merely using a single source and gate driving circuit may be alleviated.

Figure 8A:
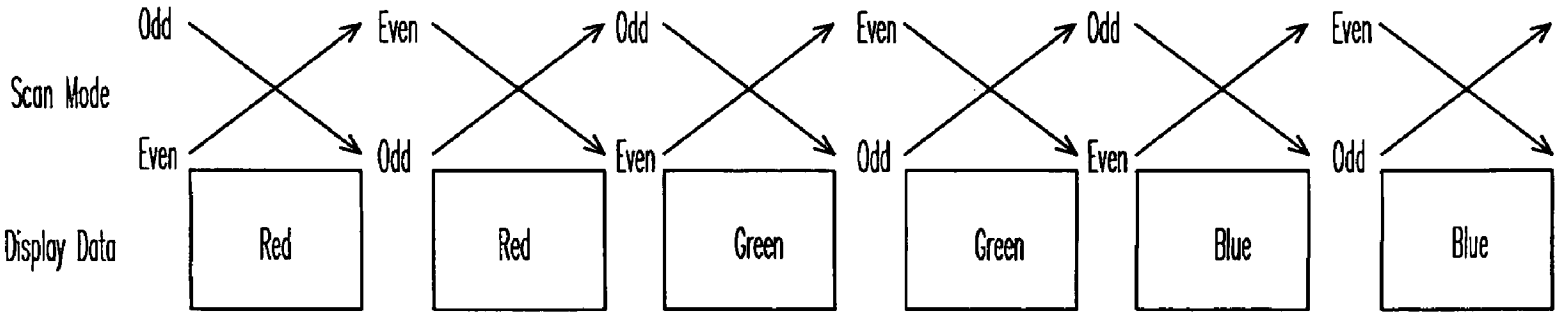
FIG. 8A is a diagram of an interlacing reversal scan mode according to an embodiment of the present invention.
Figure 9A:
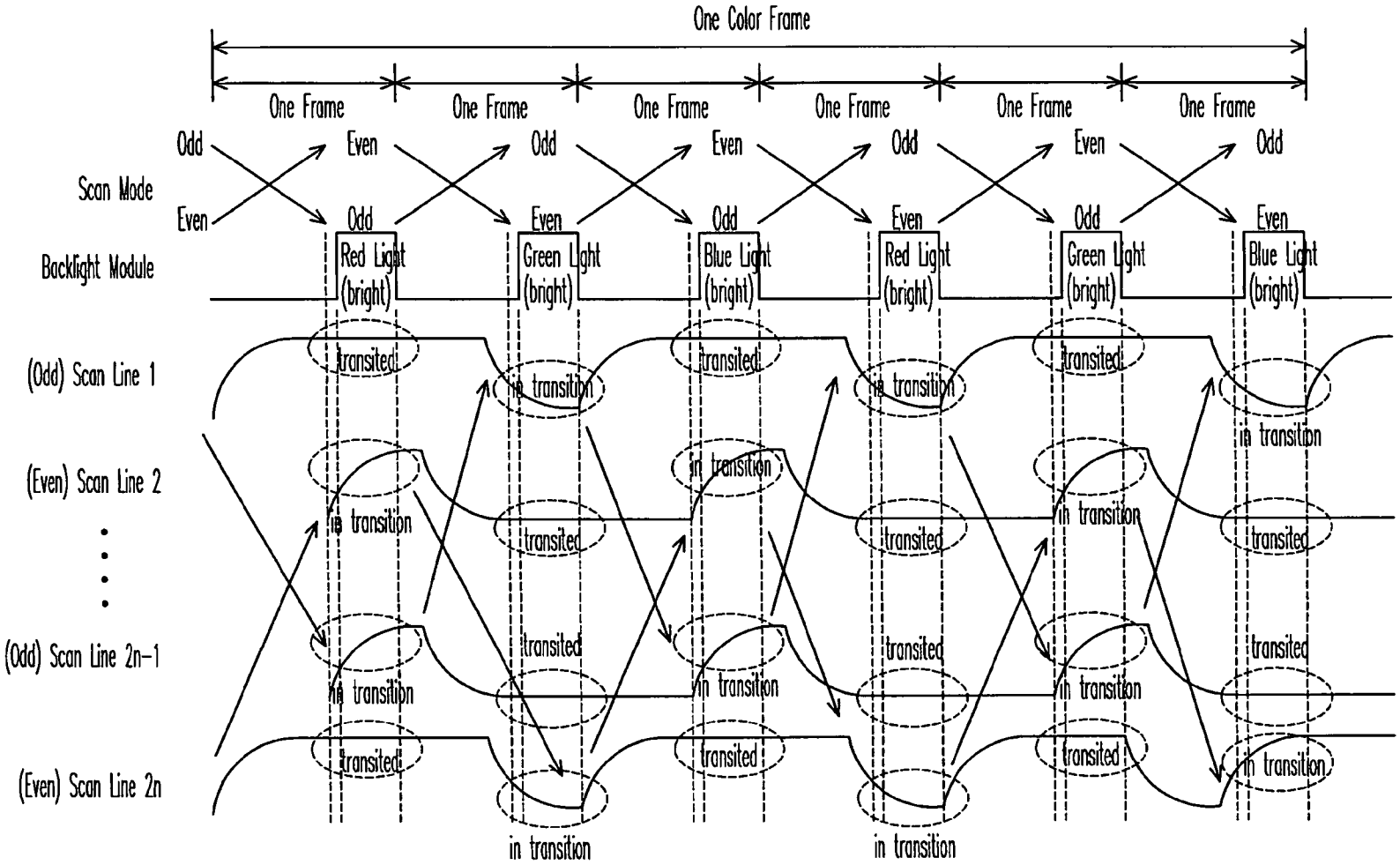
FIG. 9A is a response diagram of a transmission rate of the interlacing reversal scan mode in FIG. 8A according to an embodiment of the present invention.
Figure 10:
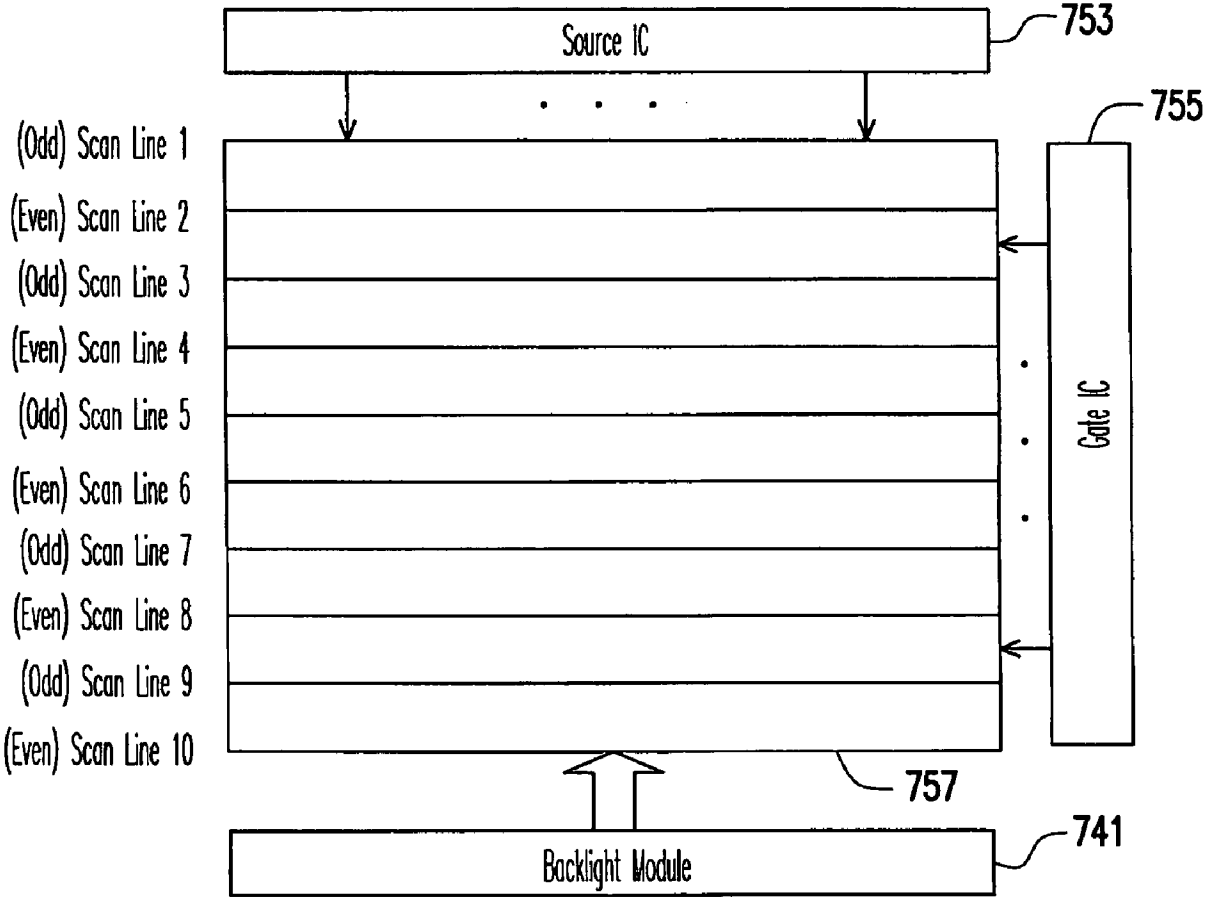
FIG. 10 is a schematic diagram of scan lines in a reversal scan mode according to an embodiment of the present invention.

FIG. 8A is a diagram of an interlacing reversal scan mode according to an embodiment of the present invention. FIG. 9A is a response diagram of a transmission rate of the interlacing reversal scan mode in FIG. 8A according to an embodiment of the present invention. FIG. 10 is a schematic diagram of scan lines in a reversal scan mode according to an embodiment of the present invention. First, referring to FIGS. 8A, 9A, and 10, in this embodiment, the number of the scan lines in the pixel array 757 is, for example, 10, and those skilled in the art should understand that the number of the scan lines is not limited herein according to the spirit of the present invention. First, during a first frame (red) scanning period, the source IC 753 is used together with the gate IC 755 to scan the scan lines in the pixel array 757. The odd scan lines and the even scan lines are alternately scanned in an odd/even interlacing sequence. The scanning sequence of the odd scan lines is from the up-side of the first frame to the down-side of the first frame, and the scanning sequence of the even scan lines is from the down-side of the first frame to the up-side of the first frame. In other words, the scanning sequence is scan line 1 (odd)→scan line 10 (even)→scan line 3 (odd)→scan line 8 (even)→scan line 5 (odd)→scan line 6 (even)→scan line 7 (odd)→scan line 4 (even)→scan line 9 (odd)→scan line 2 (even). As the response time of the liquid crystal of the scan lines in the upper part of the scanning sequence is relatively long, when the backlight module 741 is turned on, the luminance response of the liquid crystal reaches a set value. The time from the data in the lower part of the scanning sequence to the backlight module 741 which is turned on is relative short, so the time for the liquid crystal luminance response to reach a set value is not enough. Thus, an interlacing scan mode is employed to make the scan lines in the upper part of the scanning sequence cooperate with the scan lines in the lower part of the scanning sequence, such that the scan lines alternately in bright and dim may balance color distribution between the up-side and the down-side region of the frame.

Next, reversal scan is performed on a second frame (red). The odd scan lines and the even scan lines are alternately scanned in an odd/even interlacing sequence. The scanning sequence of the odd scan lines is changed into from the down-side to the up-side, and the scanning sequence of the even scan line is changed into from the up-side to the down-side. In other words, the scanning sequence is scan line 2 (even)→scan line 9 (odd)→scan line 4 (even)→scan line 7 (odd)→scan line 6 (even)→scan line 5 (odd)→scan line 8 (even)→scan line 3 (odd)→scan line 10 (even)→scan line 1 (odd). The scan lines in the lower part of the scanning sequence in the previous frame are turned into be in the upper part of the scanning sequence in this frame. That is, it is not enough that time for the luminance response above the scan lines of the previous frame to reach a set value, as there is enough time for the luminance of this frame to reach a set value. As such, the circumstance that some specific scan lines may have a poor luminance is avoided, and the scanning sequence in a reversal scan mode can achieve a more even luminance than the conventional art.

In a similar way, reversal scan is further performed on a third frame (green), and the scanning sequence is identical to the first frame. Next, the reversal scan is performed again on a fourth frame (green), and the scanning sequence is identical to the second frame. The reversal scan is also performed on a fifth frame (blue) and a sixth frame (blue). When the time for switching between frames is very short, the human eyes may not perceive the differences between the display times of the three primary colors, thereby achieving the color mixing. Therefore each pixel can display a desired color. It should be noted that, as the color mixing is performed by the use of the interlacing reversal scan together with a color sequential method, the color filter is not required for color mixing, color distribution between the up-side and the down-side region of a frame is balanced, and the flicker phenomenon in a large scope is reduced.

Those of ordinary skill in the art may change the scan mode in the above embodiment into scanning the odd and even scan lines simultaneously as required. For example, the scanning sequence of the first frame (red) is changed into scan line 1 (odd) and scan line 10 (even)→scan line 3 (odd) and scan line 8 (even)→scan line 5 (odd) and scan line 6 (even)→scan line 7 (odd) and scan line 4 (even)→scan line 9 (odd) and scan line 2 (even), and the scanning sequence of the second frame (red) is changed into scan line 2 (even) and scan line 9 (odd)→scan line 4 (even) and scan line 7 (odd)→scan line 6 (even) and scan line 5 (odd)→scan line 8 (even) and scan line 3 (odd)→scan line 10 (even) and scan line 1 (odd). The scanning sequences of other frames can be deduced in the same way, and the details will not be described herein again.

Figure 8B:
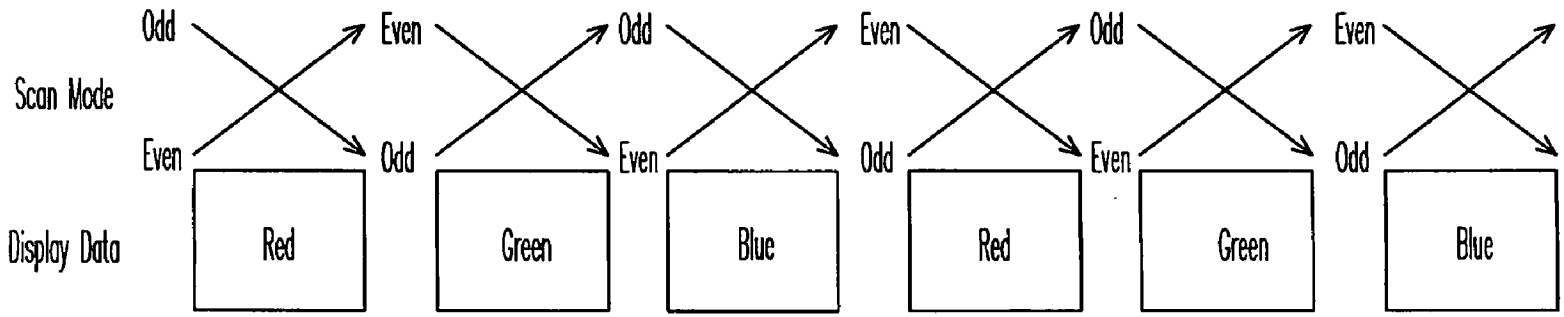
FIG. 8B is a diagram of another interlacing reversal scan mode according to an embodiment of the present invention.
Figure 9B:
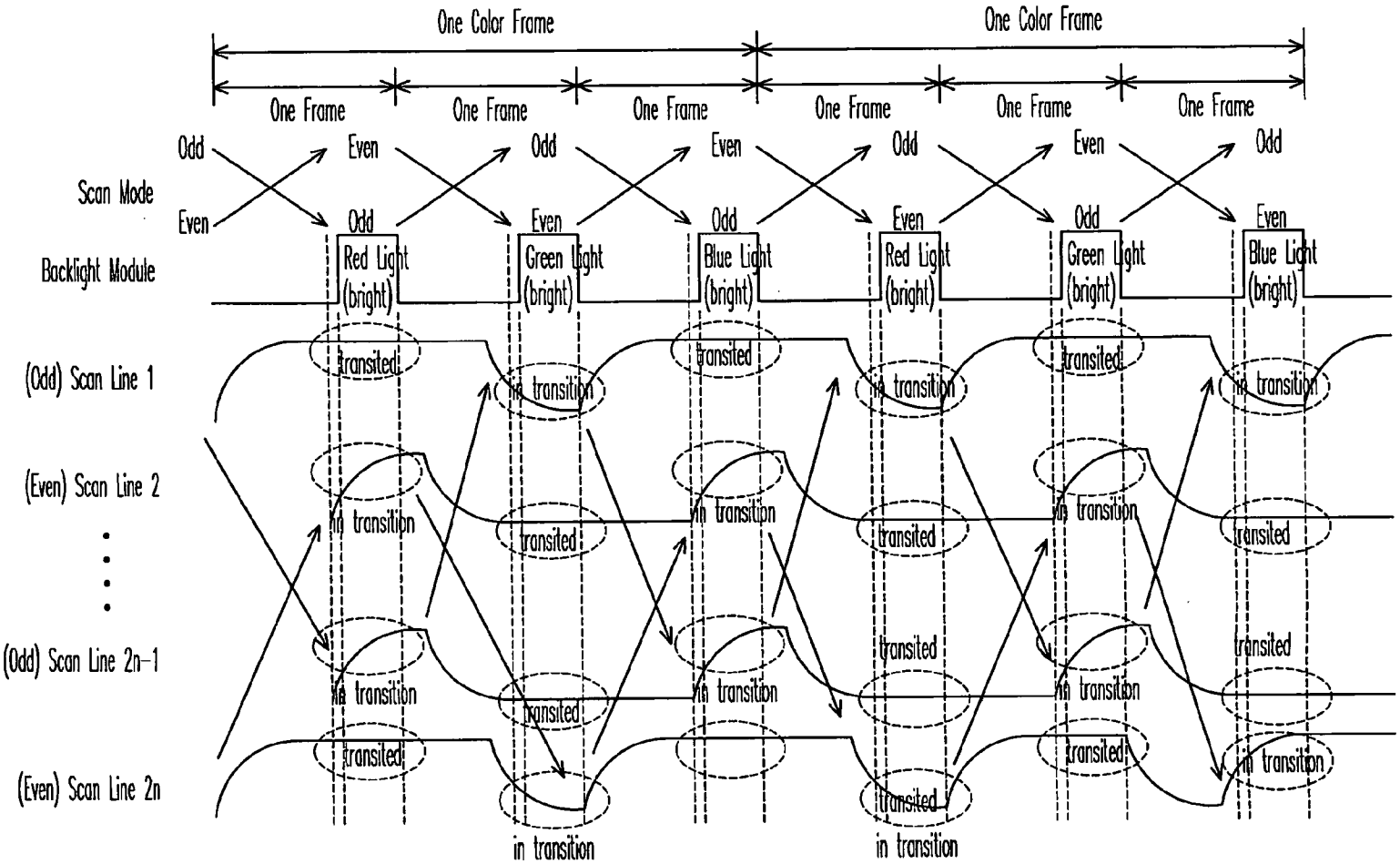
FIG. 9B is a response diagram of a transmission rate of the interlacing reversal scan mode in FIG. 8B according to an embodiment of the present invention.

Those of ordinary skill in the art can also change the implementation manner according to the spirit of the present invention and teachings from the above embodiments as required. For example, FIG. 8B is a diagram of another interlacing reversal scan mode according to an embodiment of the present invention. FIG. 9B is a response diagram of a transmission rate of the interlacing reversal scan mode in FIG. 8B according to an embodiment of the present invention. Referring to FIGS. 8B, 9B, and 10, the scan mode is similar to the above embodiment, and the details will not be described herein again. Only the color sequence of the frame is changed. That is, the color sequence illuminated by the backlight module 741 of an LED is different, and the scanning sequence of a first frame (red) is scan line 1 (odd)→scan line 10 (even)→scan line 3 (odd)→scan line 8 (even)→scan line 5 (odd)→scan line 6 (even)→scan line 7 (odd)→scan line 4 (even)→scan line 9 (odd)→scan line 2 (even).

In view of the above embodiment, the reversal scan is performed on the scanning sequence of a second frame (green), and the scanning sequence is scan line 2 (even)→scan line 9 (odd)→scan line 4 (even)→scan line 7 (odd)→scan line 6 (even)→scan line 5 (odd)→scan line 8 (even)→scan line 3 (odd)→scan line 10 (even)→scan line 1 (odd). Next, the reversal scan is further performed on the scanning sequence of a third frame (blue), and the scanning sequence is scan line 1 (odd)→scan line 10 (even)→scan line 3 (odd)→scan line 8 (even)→scan line 5 (odd)→scan line 6 (even)→scan line 7 (odd)→scan line 4 (even)→scan line 9 (odd)→scan line 2 (even). The scanning sequences and colors of other frames can be deduced in the same way, and the details will not be described herein again. As such, the color mixing effect is achieved, meanwhile color distribution between the up-side and the down-side region of a frame is balanced, and the flicker phenomenon in a large scope is reduced.

Those of ordinary skill in the art may change the scan mode of the above embodiment into scanning the odd and even scan lines by the two ICs simultaneously as required. For example, the scanning sequence of the first frame (red) is changed into scan line 1 (odd) and scan line 10 (even)→scan line 3 (odd) and scan line 8 (even)→scan line 5 (odd) and scan line 6 (even)→scan line 7 (odd) and scan line 4 (even)→scan line 9 (odd) and scan line 2 (even). The reversal scan is performed on the scanning sequence of the second frame (green), and the scanning sequence is scan line 2 (even) and scan line 9 (odd)→scan line 4 (even) and scan line 7 (odd)→scan line 6 (even) and scan line 5 (odd)→scan line 8 (even) and scan line 3 (odd)→scan line 10 (even) and scan line 1 (odd).

In view of the above, the reversal scan is further performed on the scanning sequence of a third frame (blue), and the scanning sequence is scan line 1 (odd) and scan line 10 (even)→scan line 3 (odd) and scan line 8 (even)→scan line 5 (odd) and scan line 6 (even)→scan line 7 (odd) and scan line 4 (even)→scan line 9 (odd) and scan line 2 (even). Other frames can be deduced in the same way, and the details will not be described herein again. As such, not only the color mixing effect is achieved, color distribution between the up-side and the down-side region of a frame is balanced, and the flicker phenomenon in a large scope is reduced, but also the scanning speed of the frame is accelerated.

To sum up, the scan manner of the present invention is realized by interlacing reversal scan. Thus, no matter in time and space, each color frame with poor luminance response may be alternately distributed on the up-side and the down-side region of the frame instead of being concentrated on the down-side region. As such, during the period of continuous frame displaying, the present invention may balance color distribution between the up-side and the down-side region, alleviate the flicker phenomenon of the frame, and reduce the color breakup, without increasing the operating frequency and the cost.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A display method with interlacing reversal scan, comprising:

alternately scanning a plurality of odd scan lines and a plurality of even scan lines in an odd/even interlacing sequence in a scanning period of a first frame;

wherein a $1^{st}$ scan line to be scanned of the first frame is an odd scan line from an up-side to down-side direction of the first frame, and a sequence of scanning the next scan lines comprises:

scanning a last scan line of an even scan line of the first frame from a down-side to up-side direction of the first frame;

scanning a second odd scan line after a $1^{st}$ odd scan line has been scanned from the up-side to down-side direction of the first frame;

scanning a next to last even scan line after a last even scan line has been scanned from the down-side to up-side direction of the first frame; and continuing an alternating interlacing reversal scanning sequence of odd scan lines from the up-side to down-side direction and even scan lines from the down-side to up-side direction n order until a scanning cycle of the first frame is complete.

2. A display device with interlacing reversal scan, comprising:

a timing control unit, for receiving a video source, and outputting a first control signal and a second control signal according to the video source; and a panel module, coupled to the timing control unit, for respectively driving a plurality of odd scan lines and a plurality of even scan lines of the panel module according to the first control signal and the second control signal, so as to display a plurality of frames;

wherein in a scanning period of a first frame of the frames, the odd scan lines and the even scan lines are alternately scanned in an odd/even interlacing sequence; a scanning sequence of only the odd scan lines is from an up-side of the first frame to a down-side of the first frame, and a scanning sequence of only the even scan lines is from the down-side of the first frame to the up-side of the first frame, wherein a $1^{st}$ scan line to be scanned of the first frame is an odd scan line from an up-side to down-side direction of the first frame, and a sequence of scanning the next scan lines comprises:

scanning a last scan line of an even scan line of the first frame from a down-side to up-side direction of the first frame;

scanning a second odd scan line after a $1^{st}$ odd scan line has been scanned from the up-side to down-side direction of the first frame;

scanning a next to last even scan line after a last even scan line has been scanned from the down-side to up-side direction of the first frame; and continuing an alternating interlacing reversal scanning sequence of odd scan lines from the up-side to down-side direction and even scan lines from the down-side to up-side direction in order until a scanning cycle of the first frame is complete.

3. The display device with interlacing reversal scan as claimed in claim 2, wherein in the scanning period of the first frame of the frames, the first control signal and the second control signal respectively drive the odd scan lines and the even scan lines at the same time, so as to scan the odd scan lines and the even scan lines simultaneously.

4. A display method with interlacing reversal scan, comprising:

alternately scanning a plurality of odd scan lines and a plurality of even scan lines in an odd/even interlacing sequence in a scanning period of a first frame;

wherein a $1^{st}$ scan line to be scanned of the first frame is an even scan line from an up-side to down-side direction of the first frame, and a sequence of scanning the next scan lines comprises:

scanning a last scan line of an odd scan line of the first frame from a down-side to up-side direction of the first frame;

scanning a second even scan line after a $1^{st}$ even scan line has been scanned from the up-side to down-side direction of the first frame;

scanning a next to last odd scan line after a last odd scan line has been scanned from the down-side to up-side direction of the first frame; and continuing an alternating interlacing reversal scanning sequence of even scan lines from the up-side to down-side direction and odd scan lines from the down-side to up-side direction in order until a scanning cycle of the first frame is complete.

5. A display device with interlacing reversal scan, comprising:

a timing control unit, for receiving a video source, and outputting a first control signal and a second control signal according to the video source; and a panel module, coupled to the timing control unit, for respectively driving a plurality of odd scan lines and a plurality of even scan lines of the panel module according to the first control signal and the second control signal, so as to display a plurality of frames;

wherein in a scanning period of a first frame of the frames, the odd scan lines and the even scan lines are alternately scanned in an odd/even interlacing sequence; a scanning sequence of only the even scan lines is from an up-side of the first frame to a down-side of the first frame, and a scanning sequence of only the odd scan lines is from the down-side of the first frame to the up-side of the first frame, wherein a $1^{st}$ scan line to be scanned of the first frame is an even scan line from an up-side to down-side direction of the first frame, and a sequence of scanning the next scan lines comprises:

scanning a last scan line of an odd scan line of the first frame from a down-side to up-side direction of the first frame;

scam ling a second even scan line after a $1^{st}$ even scan line has been scanned from the up-side to down-side direction of the first frame;

scanning a next to last odd scan line after a last odd scan line has been scanned from the down-side to up-side direction of the first frame; and continuing an alternating interlacing reversal scanning sequence of even scan lines from the up-side to down-side direction and odd scan lines from the down-side to up-side direction in order until a scanning cycle of the first frame is complete.

6. The display device with interlacing reversal scan as claimed in claim 5, wherein in the scanning period of the first frame of the frames, the first control signal and the second control signal respectively drive the odd scan lines and the even scan lines at the same time, so as to scan the odd scan lines and the even scan lines simultaneously.

* * * * *